US009156225B2

(12) United States Patent
Wei

(10) Patent No.: US 9,156,225 B2
(45) Date of Patent: Oct. 13, 2015

(54) PACKING STRUCTURE AND ASSEMBLING METHOD THEREOF

(71) Applicant: Wistron Corporation, New Taipei (TW)

(72) Inventor: Eva Wei, New Taipei (TW)

(73) Assignee: Wistron Corporation, New Taipei (TW)

( * ) Notice: Subject to any disclaimer, the term of this patent is extended or adjusted under 35 U.S.C. 154(b) by 75 days.

(21) Appl. No.: 14/069,386

(22) Filed: Nov. 1, 2013

(65) Prior Publication Data

US 2015/0083729 A1 Mar. 26, 2015

(30) Foreign Application Priority Data

Sep. 23, 2013 (CN) ..... 2013 1 0436255

(51) Int. Cl.
*B65D 5/49* (2006.01)
*B65D 25/04* (2006.01)
*B31B 11/00* (2006.01)

(52) U.S. Cl.
CPC ..... *B31B 11/00* (2013.01); *B65D 5/48024* (2013.01); *B65D 5/48038* (2013.01); *B65D 25/04* (2013.01)

(58) Field of Classification Search
USPC ..... 220/552, 510, 528, DIG. 15, 4.28, 676, 220/682; 206/427; 229/120.36–120.38
See application file for complete search history.

(56) References Cited

U.S. PATENT DOCUMENTS

| | | | | |
|---|---|---|---|---|
| 3,494,498 | A * | 2/1970 | Atherton | 217/33 |
| 4,703,855 | A * | 11/1987 | Moe et al. | 206/427 |
| 5,415,344 | A * | 5/1995 | Harrelson | 229/169 |
| 6,953,128 | B2 * | 10/2005 | Pfister et al. | 220/507 |
| 7,066,326 | B2 * | 6/2006 | Li et al. | 206/320 |
| 2007/0051728 | A1 * | 3/2007 | Bazany | 220/529 |

FOREIGN PATENT DOCUMENTS

EP 1100629 7/2002

* cited by examiner

*Primary Examiner* — Jeffrey Allen
*Assistant Examiner* — Jennifer Castriotta
(74) *Attorney, Agent, or Firm* — Jianq Chyun IP Office

(57) ABSTRACT

A packing structure adapted to pack a plurality of objects. The packing structure includes a plurality of first dividing plates and two side plates. The first dividing plates are arranged with intervals to form a plurality of containing spaces. Each of the first dividing plates has two sides opposite to each other, each of the sides has two first inserting slots, and a positioning portion is formed between the two first inserting slots. The two side plates are disposed at the two sides respectively. Each of the side plates has a plurality of positioning slots, and the positioning portions are respectively inserted into the positioning slots of the corresponding side plate. An extending direction of each of the first inserting slots is perpendicular to the corresponding side plate. The objects are adapted to be located in the containing spaces respectively and between the two side plates.

6 Claims, 4 Drawing Sheets

PACKING STRUCTURE AND ASSEMBLING METHOD THEREOF

CROSS-REFERENCE TO RELATED APPLICATION

This application claims the priority benefit of China application serial no. 201310436255.8, filed on Sep. 23, 2013. The entirety of the above-mentioned patent application is hereby incorporated by reference herein and made a part of this specification.

BACKGROUND

1. Field of the Application

The invention relates to a packing structure and an assembling method thereof, and more particularly, to a packing structure having a plurality of containing spaces and an assembling method thereof.

2. Description of Related Art

In recent years, along with the increasingly developments of the technology industry, electronic products such as smart phone, notebook computer, table PC, and thin client become more and more popular. The electronic products are developing towards convenient usage, multi-functions and aesthetically pleasing design direction so as to provide users with more option selections.

In general, during the manufacturing or shipment process, electronic devices and components thereof are required to be protected by packing structures before being transported. For environmental protection and cost considerations, the packing structures may be constituted of paperboards; however, since the paperboards are structurally fragile and easily be damaged, how to enable the packing structures to include favorable durability, convenience of assembly and protectively to the electronic products has become important issues for designing the packing structures.

SUMMARY OF THE APPLICATION

The invention provides a packing structure and an assembling method thereof, and this packing structure may be easily assembled and are difficult to be damaged.

The packing structure of the invention is adapted to package a plurality of objects. The packing structure includes a plurality of first dividing plates and two side plates. The first dividing plates are arranged with intervals to form a plurality of containing spaces. Each of the first dividing plates has two sides opposite to each other, each of the sides has two first inserting slots, and a positioning portion is formed between the two first inserting slots. The two side plates are respectively disposed at the two sides. Each of the side plates has a plurality of positioning slots, and the positioning portions are respectively inserted into the positioning slots of the corresponding side plate. An extending direction of each of the first inserting slots is perpendicular to the corresponding side plate. The objects are adapted to be located in the containing spaces and between the two side plates.

In an embodiment of the invention, each of the side plates has two folding walls, the positioning slots are located between the two folding walls, and the two folding walls are respectively inserted into the two first inserting slots of the corresponding side plate.

In an embodiment of the invention, a distance between each of the folding walls and the positioning slots equals to a width of the corresponding first inserting slot.

In an embodiment of the invention, the packing structure further includes a second dividing plate, wherein the second dividing plate has a plurality of second inserting slots, each of the first dividing plates has a top edge, the top edge connects between the two sides and has a third inserting slot, the second inserting slots are respectively aligned to the third inserting slots, the first dividing plates and the second dividing plate are inserted into each other through the second inserting slots and the third inserting slots, and the second dividing plate divides each of the containing spaces into two subspaces.

In an embodiment of the invention, a width of each of the first dividing plates along an extending direction of the side is greater than a width of each of the side plates along an extending direction of the side.

An assembling method of the packing structure of the invention includes the following steps. A plurality of first dividing plates are provided, wherein the first dividing plates are arranged with intervals, each of the first dividing plates has two sides opposite to each other, each of the sides has two first inserting slots, and a positioning portion is foamed between the two first inserting slots. Two side plates are provided, wherein each of the side plates has a plurality of positioning slots. The two side plates are respectively disposed at the two sides, wherein an extending direction of each of the first inserting slots is perpendicular to the corresponding side plate, and the step of disposing each of the side plates at the corresponding side plate includes respectively inserting the positioning portions into the positioning slots of the corresponding side plate.

In an embodiment of the invention, each of the side plates has two folding walls, the positioning slots are located between the two folding walls, and the step of disposing each of the side plates at the corresponding side plate includes respectively inserting the two folding walls into the two first inserting slots of the corresponding side plate.

In an embodiment of the invention, each of the first dividing plates has a top edge, the top edge connects between the two sides and has a third inserting slot, and the step of arranging the first dividing plates with intervals includes the following steps. A second dividing plate is provided, wherein the second dividing plate has a plurality of second inserting slots. The second inserting slots are respectively aligned to the third inserting slot. The first dividing plates and the second dividing plate are inserted into each other through the second inserting slots and the third inserting slot, so that the first dividing plates are arranged with intervals.

In view of the foregoing, in the packing structure of the invention, the side of each of the first dividing plates has the two first inserting slots, and thereby constitutes the positioning portion located between the two first inserting slots. A user may stably fix the side plates at the side of each of the first dividing plates by merely arranging the first dividing plates with intervals and respectively inserting the positioning portions of the first dividing plates into the positioning slots of the side plates. Hence, the packing structure of the invention is very convenient in terms of assembly. In addition, the extending direction of each of the first inserting slots is perpendicular to the corresponding side plate, so that the side plates and the first dividing plates are inserted into each other along a thickness direction of the side plates rather than along a length direction or a width direction of the side plates; and therefore, the first inserting slots can finish the assembly between themselves and the side plates by merely requiring to have a smaller depth. As such, configurations of the packing structure at the sides of the first dividing plates are avoid from being easily damaged due to the slots being too long, and thus the durability of the packing structure and the protectively to the objects packaged thereby are enhanced.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DETAILED DESCRIPTION OF DISCLOSED EMBODIMENTS

Figure 1:
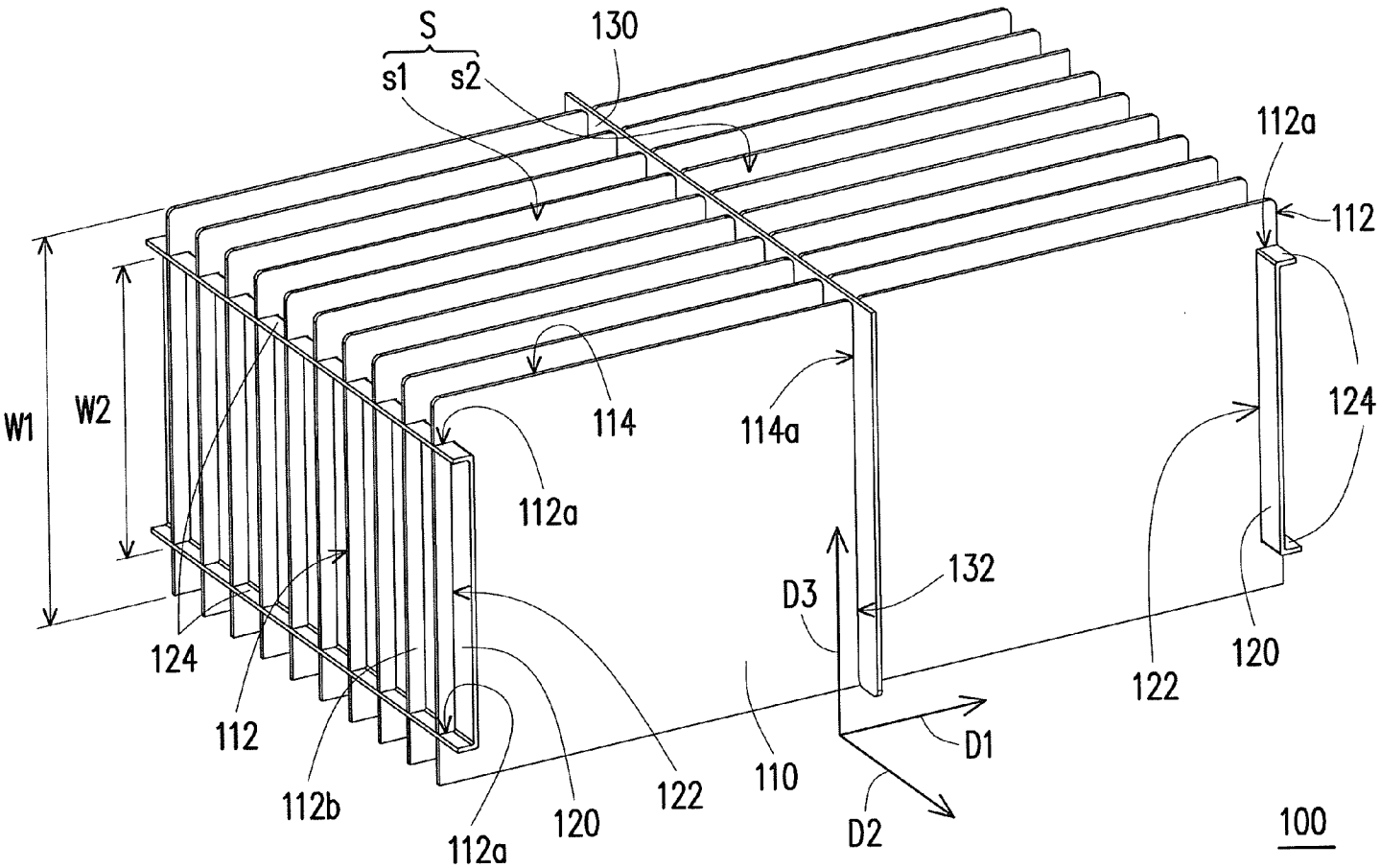
FIG. 1 is a perspective view of a packing structure according to an embodiment of the invention.
Figure 2:
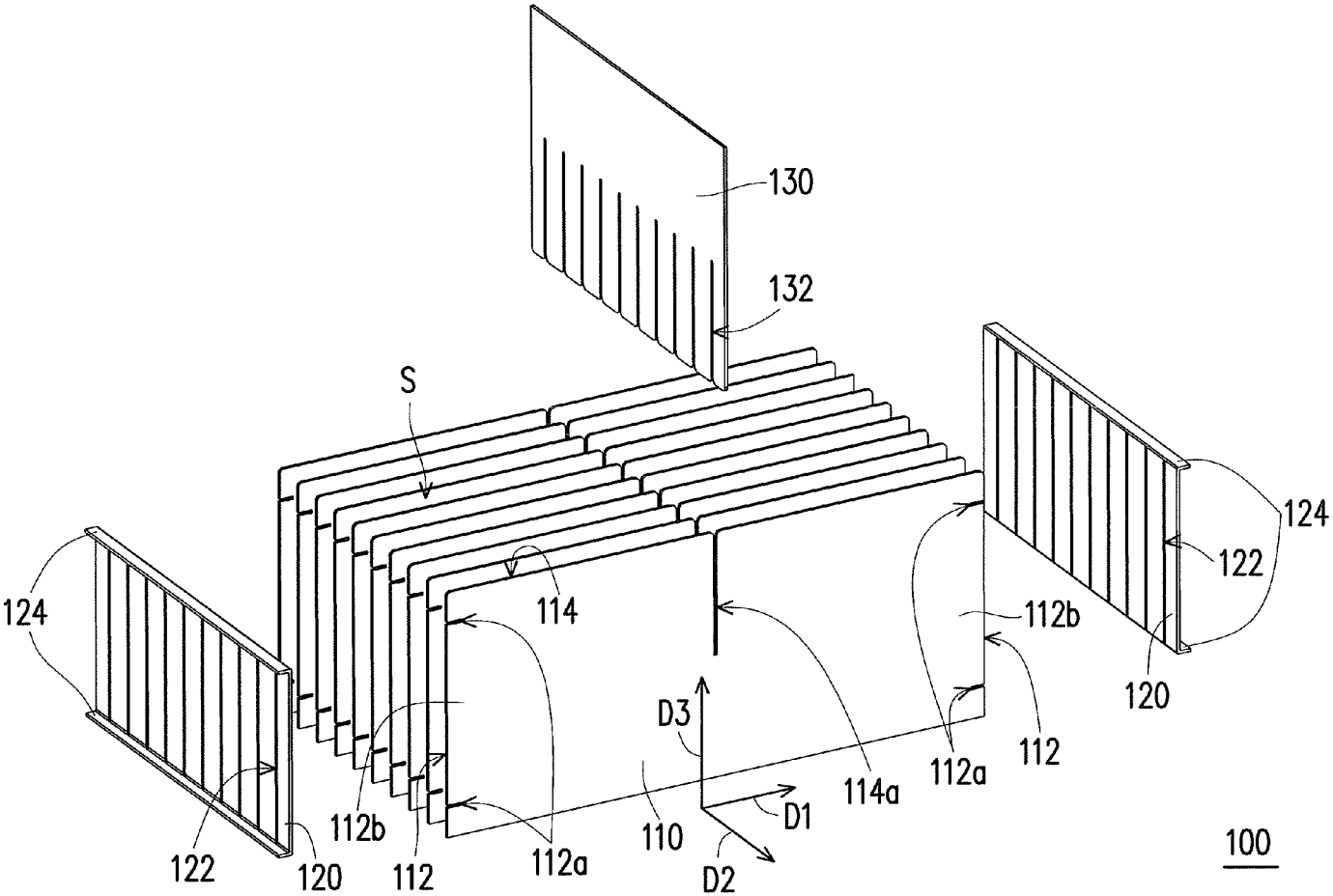
FIG. 2 is an exploded view of the packaging structure of FIG. 1.

FIG. 1 is a perspective view of a packing structure according to an embodiment of the invention. FIG. 2 is an exploded view of the packaging structure of FIG. 1. Referring to FIG. 1 and FIG. 2, the packing structure 100 of the present embodiment includes a plurality of first dividing plates 110 and two side plates 120. The first dividing plates 110 are arranged with intervals to form a plurality of containing spaces S. Each of the first dividing plates 110 has two sides 112 opposite to each other and is connected to a top edge 114 between the two sides 112. Each of the sides 112 has two first inserting slots 112*a*, and a positioning portion 112*b* is formed between the two first inserting slots 112*a*. The two side plates 120 are respectively disposed at the two sides 112 of each of the first dividing plates 110. Each of the side plates 120 has a plurality of positioning slots 122, the positioning slots 122 are parallel to each other and arranged with intervals, and the positioning portions 112*b* are respectively inserted into the positioning slots 122 of the corresponding side plate 120, wherein an extending direction (viz., direction D1) of each of the first inserting slots 112*a* is perpendicular to the corresponding side plate 120.

The packing structure 100 further includes a second dividing plate 130, the second dividing plate 130 has a plurality of second inserting slots 132, the second inserting slots 132 are parallel to each other and arranged with intervals, the top edge 114 of each of the first dividing plates 110 has a third inserting slot 114*a*, the second inserting slots 132 of the second dividing plate 130 are respectively aligned to the third inserting slots 114*a*, and the first dividing plates 110 and the second dividing plate 130 are inserted into each other through the second inserting slots 132 and the third inserting slots 114*a*. The second dividing plate 130 divides each of the containing spaces S into two subspaces (labeled as s1 and s2 in FIG. 1), and a plurality of objects (not shown) are adapted to be located in the portion s1 and portion s2 of each of the containing spaces S and between the two side plates 120. The objects, for example, are printed circuit boards, thin clients, or other types of electronic devices or components, but the invention is not limited thereto.

Under the aforementioned configuration, a user may stably fixe the side plates 120 at the sides 112 of the each of the first dividing plates 110 by merely arranging the first dividing plates 110 with intervals and respectively inserting the positioning portions 112*b* of the first dividing plates 110 inserted into the positioning slots 122 of the side plates 120; and therefore, the packing structure 100 of the present embodiment is very convenient in terms of assembly. In addition, the extending direction (viz., direction D1) of each of the first inserting slots 112*a* is perpendicular to the corresponding side plate 120, so that the side plates 120 and the first dividing plates 110 are inserted into each other along a thickness direction (viz., direction D1) of the side plates 120 rather than a length direction (viz., direction D2) or a width direction (viz., direction D3) of the side plates 120. Thus, the first inserting slots 112*a* can finish the assembly between themselves and the side plates 120 by merely requiring to have a smaller depth. As such, the configurations of the packing structure 100 at the sides 112 of the first dividing plates 110 are avoid from being easily damaged due to the slots being too long, and thus the durability of the packing structure 100 and the protectively to the objects packaged thereby are enhanced. A material of the first dividing plates 110, the side plates 120 and the second dividing plate 130 of the present embodiment, for example, is a paperboard; and in other embodiments, the first dividing plates 110, the side plates 120 and the second dividing plate 130 may also be made of other appropriate materials, the invention is not limited thereto.

In the present embodiment, each of the side plates 120 has two folding walls 124, the positioning slots 122 are located between the two folding walls 124, and the two folding walls 124 are respectively inserted into the two first inserting slots 112*a* of the corresponding side plate 112. As such, the structural strength of packing structure 100 at the sides 112 of the first dividing plates 110 may be enhanced, thereby further improving the durability of the packing structure 100.

Referring to FIG. 1, a width W1 of each of the first dividing plates 110 of the present embodiment along the extending direction (viz., direction D3) of the side 112 is greater than a width W2 of each of the side plates 120 along the extending direction (viz., direction D3) of the side 112. As such, the side plates 120 do not cause excessive blocking to the objects within the containing spaces S, and thus the user may easily remove the objects from the containing spaces S.

Figure 3:
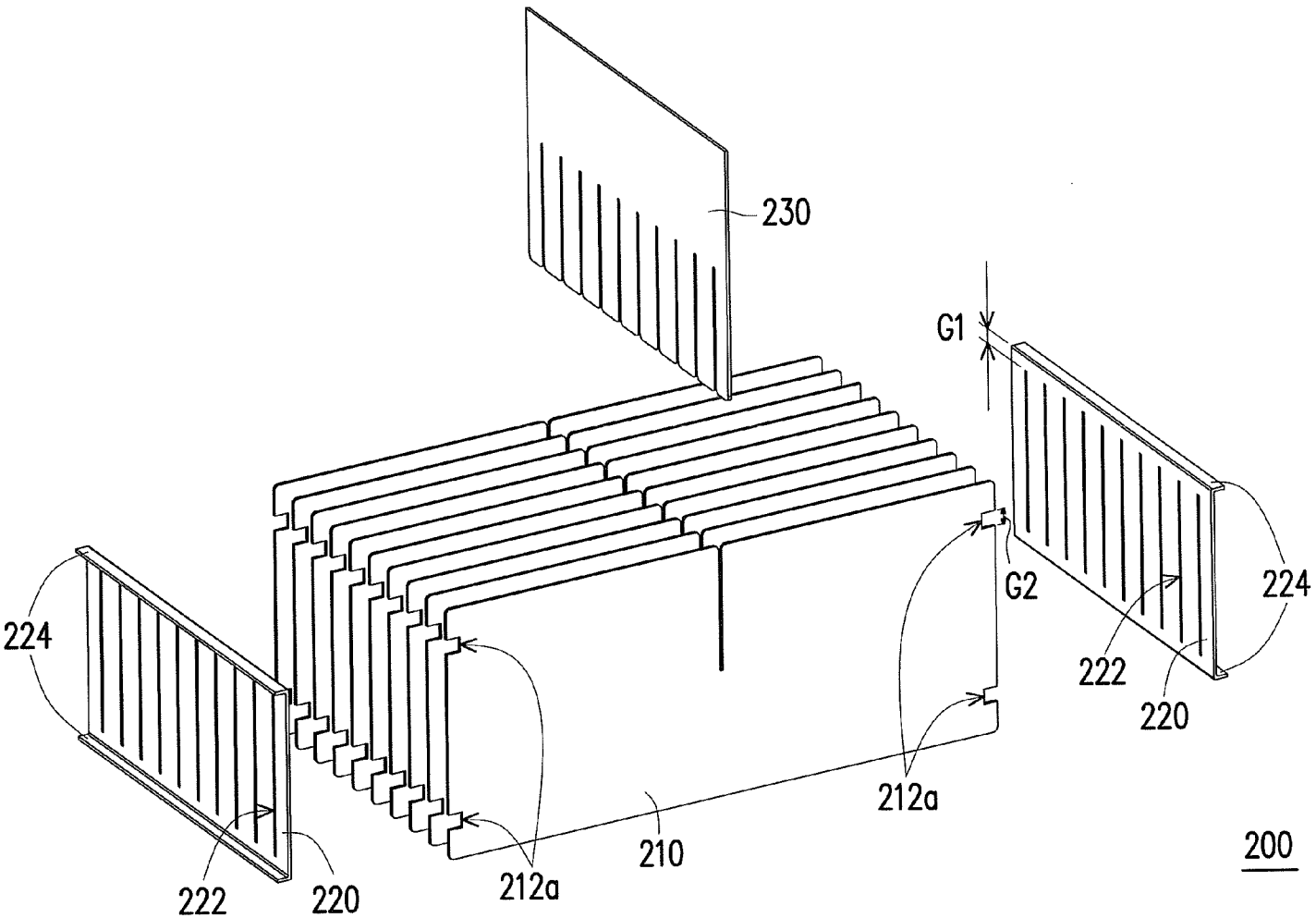
FIG. 3 is an exploded view of a packing structure according to another embodiment of the invention.

FIG. 3 is an exploded view of a packing structure according to another embodiment of the invention. In the packing structure 200 of FIG. 3, configurations of the first dividing plates 210, the side plates 220 and the second dividing plate 230 are similar to that of the first dividing plates 110, the side plates 120 and the second dividing plate 130 of FIG. 2, and thus are to be repeated herein. Differences between the packing structure 200 and the packing structure 100 are that, a length of the positioning slots 222 are relative smaller, so that each of the folding walls 224 and the positioning slots 222 have a distance G1 therebetween. Correspondingly, a width G2 of each of the first inserting slots 212*a* of the first dividing plates 210 is designed to be equal to the distance G1, so that the side plates 220 can be smoothly assembled with the dividing first plates 210. In other embodiments, the positioning slots may be adjusted into other appropriate length according to the needs, and the width of the first inserting slots may also be correspondingly adjusted.

Figure 4:
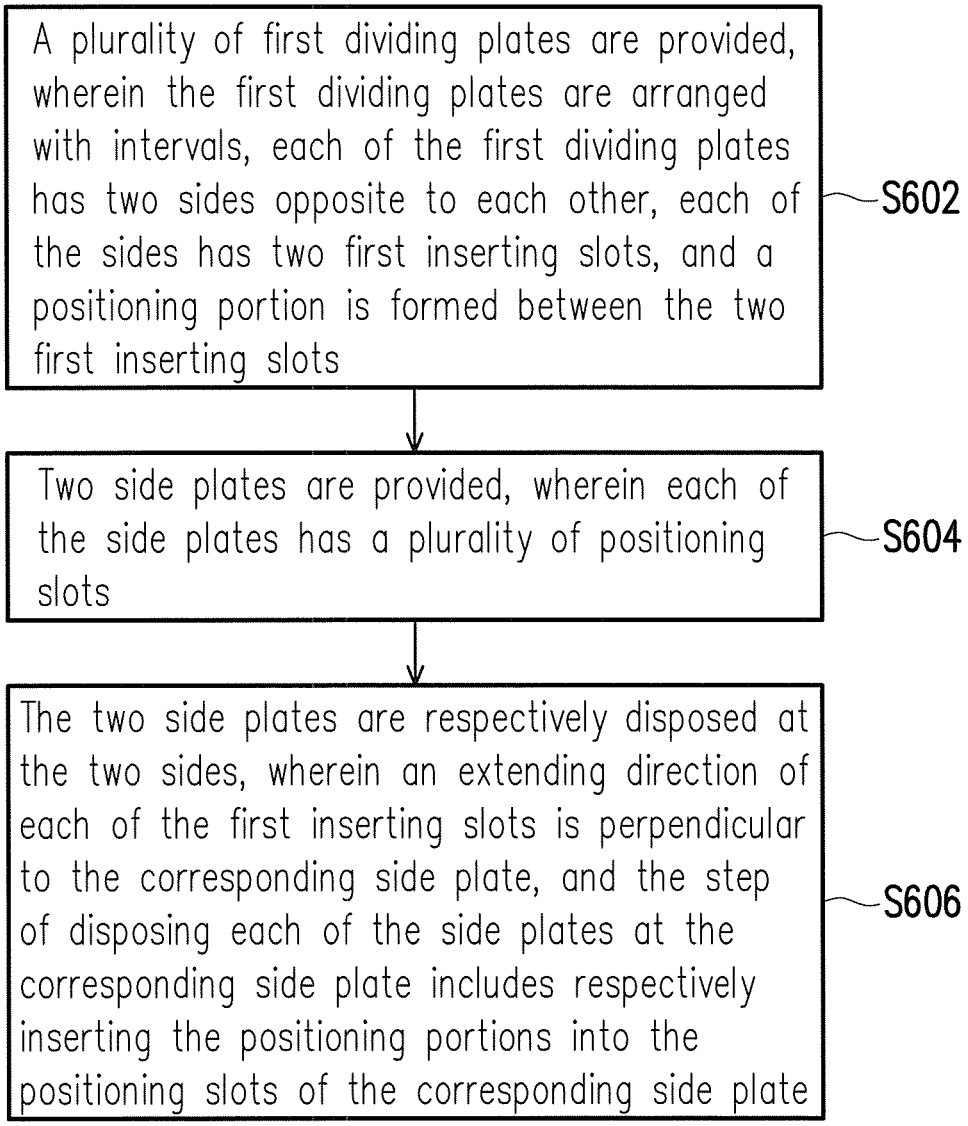
FIG. 4 is a flow chart of an assembling method of a packing structure according to an embodiment of the invention.

In the following below, the packing structure 100 shown in FIG. 1 and FIG. 2 is taken as an example for describing the assembling method of the invention. FIG. 4 is a flow chart of an assembling method of a packing structure according to an embodiment of the invention. Referring to FIG. 1, FIG. 2 and FIG. 4, firstly, the first dividing plates 110 shown in FIG. 2 are provided, wherein the first dividing plates 110 are arranged with intervals, each of the first dividing plates 110 has the two sides 112 opposite to each other, each of the sides 112 has the two first inserting slots 112*a*, and the positioning portion 112*b* is formed between the two first inserting slots 112*a* (step S602). Next, the two side plates 120 shown in FIG. 2 are provided, wherein each of the side plates 120 has the positioning slots 122 (step S604). As shown in FIG. 1, the two side plates 120 are respectively disposed at the two sides 112, wherein the extending direction (viz., direction D1) of each of the first inserting slots 112*a* is perpendicular to the corresponding side plate 120, and the step of disposing each of the side plates 120 at the corresponding side plate 112 includes respectively inserting the positioning portions 112*b* into the positioning slots 122 of the corresponding side plate 112 (step S606).

In the step S602 mentioned above, the second dividing plate 130 shown in FIG. 2 is further provided, and the second inserting slots 114*a* of the first dividing plates 110 are respectively aligned to the third inserting slots 132 of the second dividing plate 130. Next, the first dividing plates 110 and the second dividing plate 130 are inserted into each other through the second inserting slots 114*a* and the third inserting slots 132, so that the first dividing plates 110 are arranged with intervals.

In addition, as the step S606 mentioned above, in the process of disposing each of the side plates 120 at the corresponding side plate 112, the two folding walls 124 of the side plates 120 may be respectively inserted into the two first inserting slots 112*a* of the corresponding side plate 112, so as to enhance the structure strength of the packing structure 100 at the sides 112 of the first dividing plates 110.

In summary, in the packing structure of the invention, the side of each of the first dividing plates has the two first inserting slots, and thereby constitutes the positioning portion located between the two first inserting slots. The user may stably fix the side plates at the side of each of the first dividing plates by merely arranging the first dividing plates with intervals and respectively inserting the positioning portions of the first dividing plates into the positioning slots of the side plates. Hence, the packing structure of the invention is very convenient in terms of assembly. In addition, the extending direction of each of the first inserting slots is perpendicular to the corresponding side plate, so that the side plates and the first dividing plates are inserted into each other along the thickness direction of the side plates rather than along the length direction or the width direction of the side plates; and therefore, the first inserting slots can finish the assembly between themselves and the side plates by merely requiring to have the smaller depth. As such, configurations of the packing structure at the sides of the first dividing plates are avoid from being easily damaged due to the slots being too long, and thus the durability of the packing structure and the protectively to the objects packaged thereby are enhanced.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. A packing structure adapted to pack a plurality of objects, the packing structure comprising:

a plurality of first dividing plates arranged at intervals to form a plurality of containing spaces, wherein each of the first dividing plates has two sides opposite to each other, each of the sides has two first inserting slots, and a positioning portion is formed between the two first inserting slots; and two side plates respectively disposed at the two sides, wherein each of the side plates has a plurality of positioning slots, the positioning portions are respectively inserted into the positioning slots of the corresponding side plate, an extending direction of each of the first inserting slots is perpendicular to the corresponding side plate, the objects are adapted to be respectively located in the containing spaces and between the two side plates, each of the side plates has two folding walls, the positioning slots are located between the two folding walls, and the two folding walls are respectively inserted into the two first inserting slots of the corresponding side.

2. The packing structure as recited in claim 1, wherein a distance between each of the folding walls and the positioning slots equals to a width of the corresponding first inserting slot.

3. The packing structure as recited in claim 1, further comprising a second dividing plate, wherein the second dividing plate has a plurality of second inserting slots, each of the first dividing plates has a top edge, the top edge connects between the two sides and has a third inserting slot, the second inserting slots are respectively aligned to the third inserting slots, the first dividing plates and the second dividing plate are inserted into each other through the second inserting slots and the third inserting slots, and the second dividing plate divides each of the containing spaces into two subspaces.

4. The packing structure as recited in claim 1, wherein a width of each of the first dividing plates along a vertical direction of the side is greater than a width of each of the side plates along a vertical direction of the side.

5. An assembling method of a packing structure comprising:

providing a plurality of first dividing plates, wherein the first dividing plates are arranged at intervals, each of the first dividing plates has two sides opposite to each other, each of the sides has two first inserting slots, and a positioning portion is foinied between the two first inserting slots;

providing two side plates, wherein each of the side plates has a plurality of positioning slots; and respectively disposing the two side plates at the two sides, wherein an extending direction of each of the first inserting slots is perpendicular to the corresponding side plate, the step of disposing each of the side plates at the corresponding side comprises respectively inserting the positioning portions into the positioning slots of the corresponding side plate, each of the side plates has two folding walls, the positioning slots are located between the two folding walls, and the step of disposing each of the side plates at the corresponding side comprises respectively inserting the two folding walls into the two first inserting slots of the corresponding side.

6. The assembling method as recited in claim 5, wherein each of the first dividing plates has a top edge, the top edge connects between the two sides and has a third inserting slot, and the step of arranging the first dividing plates at intervals comprises:

providing a second dividing plate, wherein the second dividing plate has a plurality of second inserting slots;

respectively aligning the second inserting slots to the third inserting slots; and inserting the first dividing plates and the second dividing plate with each other through the second inserting slots and the third inserting slots, so that the first dividing plates are arranged at intervals.

* * * * *